US008686586B1

(12) United States Patent
Tsai

(10) Patent No.: US 8,686,586 B1
(45) Date of Patent: Apr. 1, 2014

(54) LIGHTING MICRO HYDRAULIC POWER GENERATOR

(71) Applicant: Pi-Kuang Tsai, Taichung (TW)

(72) Inventor: Pi-Kuang Tsai, Taichung (TW)

(73) Assignee: Agreat Shower & Sanitary (Xiamen) Co., Ltd., Xiamen, Fujian Province (CN)

( * ) Notice: Subject to any disclaimer, the term of this patent is extended or adjusted under 35 U.S.C. 154(b) by 0 days.

(21) Appl. No.: 13/725,967

(22) Filed: Dec. 21, 2012

(51) Int. Cl.
*B05B 1/14* (2006.01)

(52) U.S. Cl.
USPC ..... 290/54; 362/192

(58) Field of Classification Search
USPC ..... 290/54; 362/192
See application file for complete search history.

(56) References Cited

U.S. PATENT DOCUMENTS 5,207,499 A * 5/1993 Vajda et al. ..... 362/96
5,982,059 A * 11/1999 Anderson ..... 310/50
6,036,333 A * 3/2000 Spiller ..... 362/192
7,387,401 B2 * 6/2008 Clark ..... 362/192
7,571,867 B2 * 8/2009 Hu ..... 239/383

FOREIGN PATENT DOCUMENTS

CN 2910369 Y * 6/2007
CN 201116508 Y * 9/2008
CN 101284260 A * 10/2008
JP 2003027537 A * 1/2003
WO WO 2009000109 A1 * 12/2008

* cited by examiner

*Primary Examiner* — Joseph Waks
(74) *Attorney, Agent, or Firm* — Chun-Ming Shih

(57) ABSTRACT

A lighting micro hydraulic power generator includes a leaving water shell, a coil module, a lighting module, a fan, and an entering water cover. The leaving water shell has a container, a plurality of leaving water holes, and a screw thread. The coil module is set within the container of the leaving water shell, which is able to receiving external force for power generation and outputting power. The lighting module is set on the bottom of the leaving water shell, wherein the lighting module is electrically connected to the coil module, and is powered by the coil module to emit light. The fan is connected to the coil module, when the fan is driven by the external force to rotate, it is able to drive the coil module to generate and output power.

4 Claims, 14 Drawing Sheets

LIGHTING MICRO HYDRAULIC POWER GENERATOR

BACKGROUND OF THE INVENTION

1. Field of the Invention

The present invention relates to a power generator, more specifically, the present invention relates to a lighting micro hydraulic power generator.

2. Description of the Prior Art

Generally, water tap or similar equipment is set in bath room, kitchen, or other place in a building.

But, when there is no light, or power is cut, the user cannot see whether the cleaning object or body is cleaned up. If an electrical lighting equipment is additionally set, it would cause extra power consumption.

Thus, it is necessary to directly convert the water flowing into power for lighting.

SUMMARY OF THE INVENTION

The objective of the present invention is to provide a lighting micro hydraulic power generator, converting the momentum of water flowing into power for lighting.

Another objective of the present invention is to provide a lighting micro hydraulic power generator for being set with a water tap or similar equipment to convert the momentum of water flowing into power for light without consuming electric power.

The lighting micro hydraulic power generator of the present invention comprises: a leaving water shell, comprising a container, wherein the leaving water shell is set with a plurality of leaving water holes on the outside surface of the leaving water shell, and the leaving water holes are connected to the surface of the leaving water shell, and the outside surface of the leaving water shell is set with an external screw thread; a coil module, set within the container of the leaving water shell, which is able to receiving external force for power generation and outputting power; a lighting module, set on the bottom of the leaving water shell, wherein the lighting module is electrically connected to the coil module, and is powered by the coil module to emit light; a fan, set on the top of the leaving water shell, wherein the fan is connected to the coil module, when the fan is driven by the external force to rotate, it is able to drive the coil module to generate and output power; an entering water cover, set on the top of the leaving water shell, wherein the entering water cover is set with a plurality of entering water holes, and the entering water holes are connected to the top of the leaving water shell, and the fan is set between the entering water holes and the leaving water holes.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
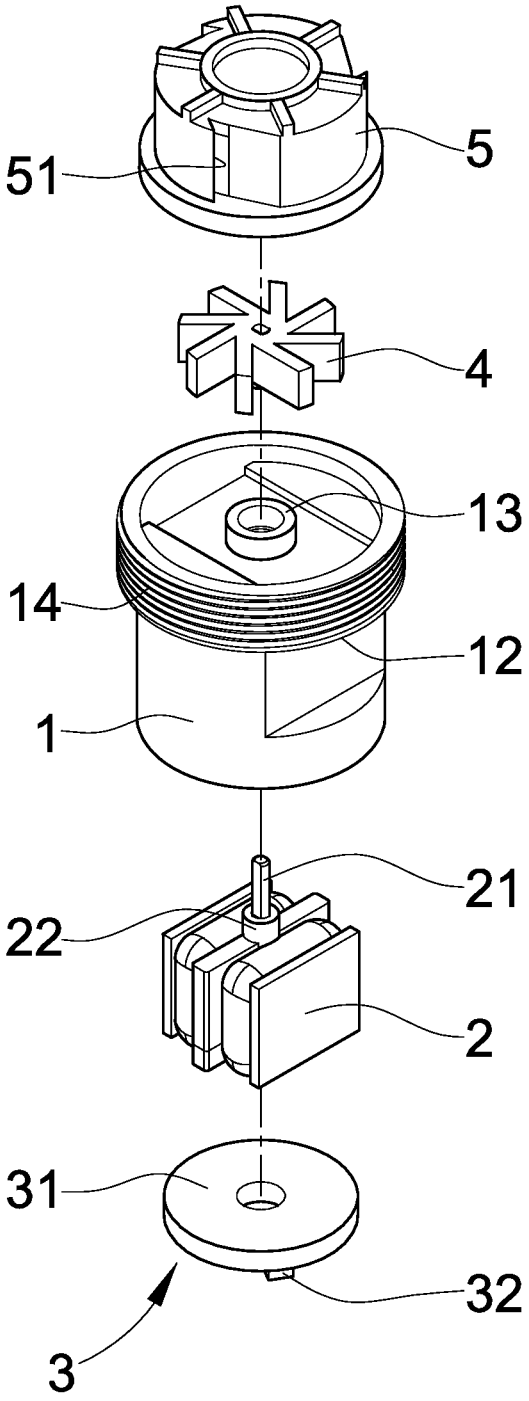
FIG. 1 shows the explosion diagram of the first preferred embodiment of the present invention.
Figure 2:
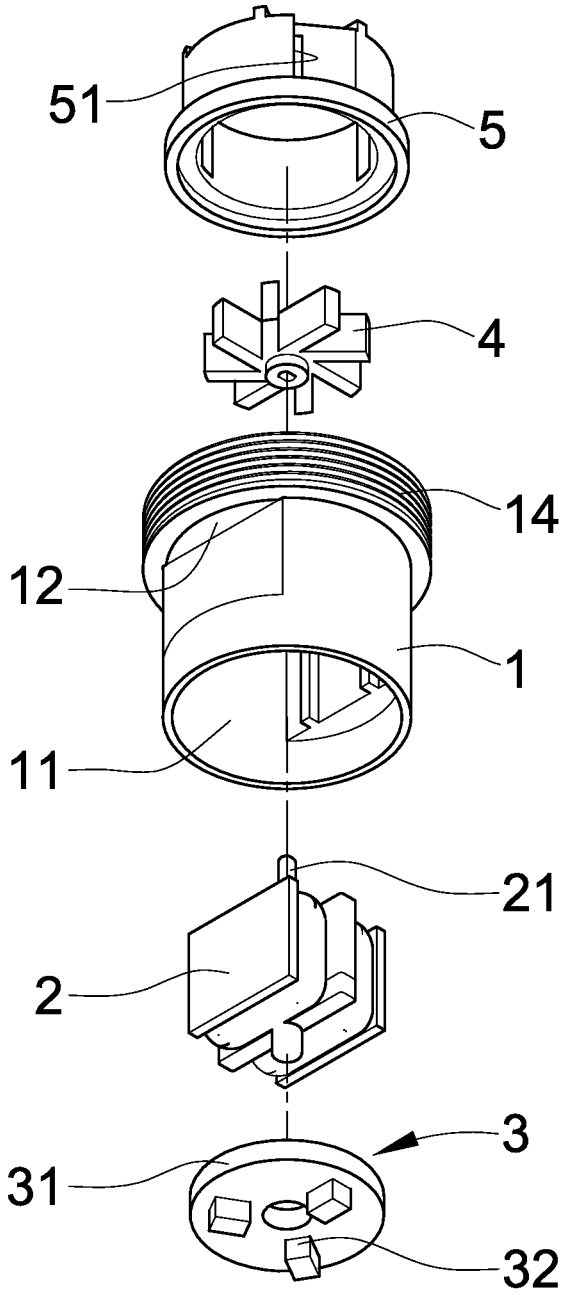
FIG. 2 shows another view for the explosion diagram of the embodiment shown in FIG. 1.
Figure 3:
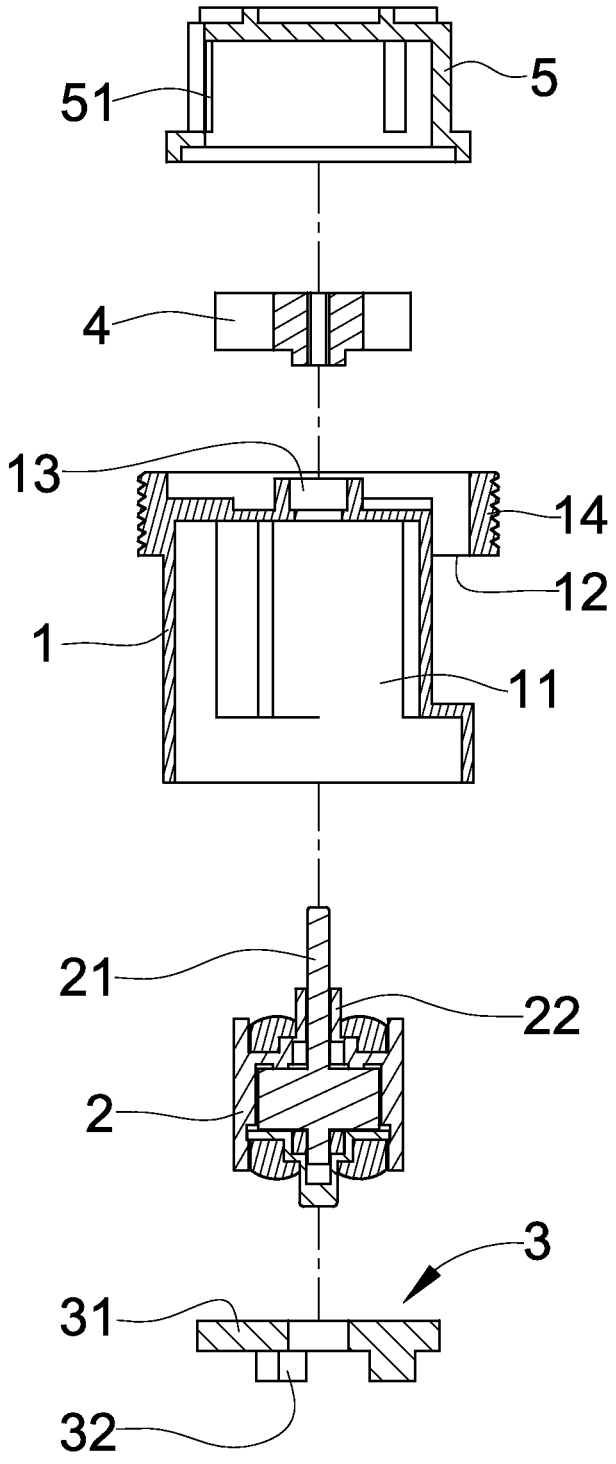
FIG. 3 shows the cross-sectional view diagram of the embodiment shown in FIG. 1.
Figure 4:
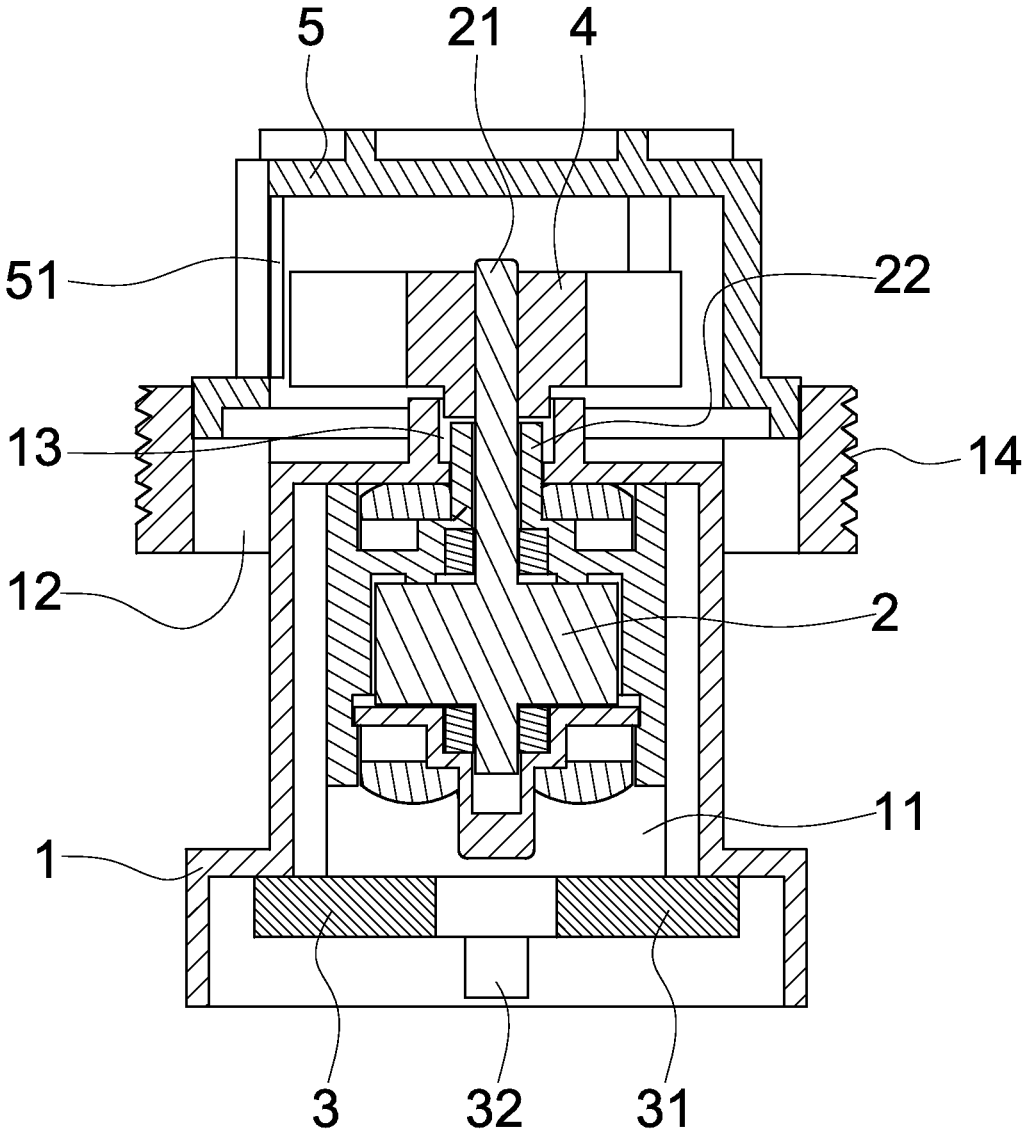
FIG. 4 shows the structure view diagram of the embodiment shown in FIG. 1.

Referring to FIGS. 1-7, it is realized that the lighting micro hydraulic power generator mainly comprises: a leaving water shell 1, a coil module 2, a lighting module 3, a fan 4, and an entering water cover 5.

Referring to FIGS. 1-4, it is realized that the leaving water shell 1 is set with a plurality of leaving water holes 12 on the outside surface of the leaving water shell 1, and the leaving water holes 12 are connected to the surface of the leaving water shell 1, the top of the leaving water shell 1 has a through hole 13 to the container 11, and the outside surface of the leaving water shell 1 is set with an external screw thread 14 around the leaving water shell 1.

Referring to FIGS. 1-4, the coil module 2 is set within the container 11 of the leaving water shell 1, which is able to receiving external force for power generation and outputting power. The coil module 2 has an input axis 21, and the input axis 21 protrudes outward from the through hole 13 of the leaving water shell 1.

Referring to FIGS. 1-4, the lighting module 3 is set on the bottom of the leaving water shell 1, wherein the lighting module 3 is electrically connected to the coil module 2, and is powered by the coil module 2 to emit light. The lighting module 3 has a circuitry board 31 and a plurality of lighting units 32, the circuitry board 31 is electrically connected to the coil module 2, and the plurality of lighting units 32 are electrically connected to the circuitry board 31 and placed toward the bottom of the leaving water shell 1. The lighting unit 32 can be a Light Emitting Diode, LED.

Referring to FIGS. 1-4, the fan 4 is set on the top of the leaving water shell 1, wherein the fan 4 is connected to input axis 21 of the coil module 2, when the fan 4 is driven by the external force to rotate, it is able to drive the coil module 2 to generate and output power.

Referring to FIGS. 1-4, the entering water cover 5 is set on the top of the leaving water shell 1, wherein the entering water cover 5 is set with a plurality of entering water holes 51 having a predetermined spacing distance, and the entering water holes 51 are connected to the top of the leaving water shell 1, and the fan 4 is set between the entering water holes 51 and the leaving water holes 12.

The aforementioned paragraphs disclose the main parts and structure of the first preferred embodiment of the lighting micro hydraulic power generator of the present invention. The application characters are disclosed as follows.

Figure 5:
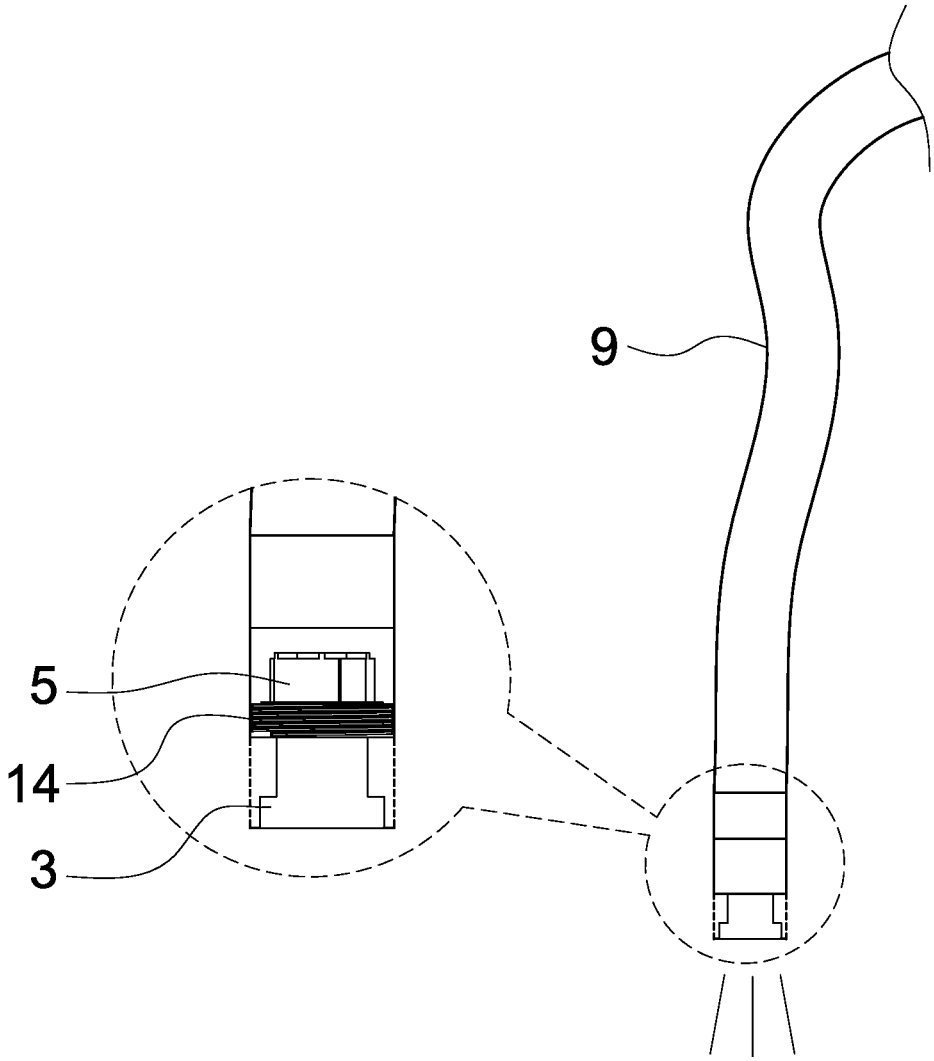
FIG. 5 shows the operation status diagram of the embodiment shown in FIG. 1.
Figure 6:
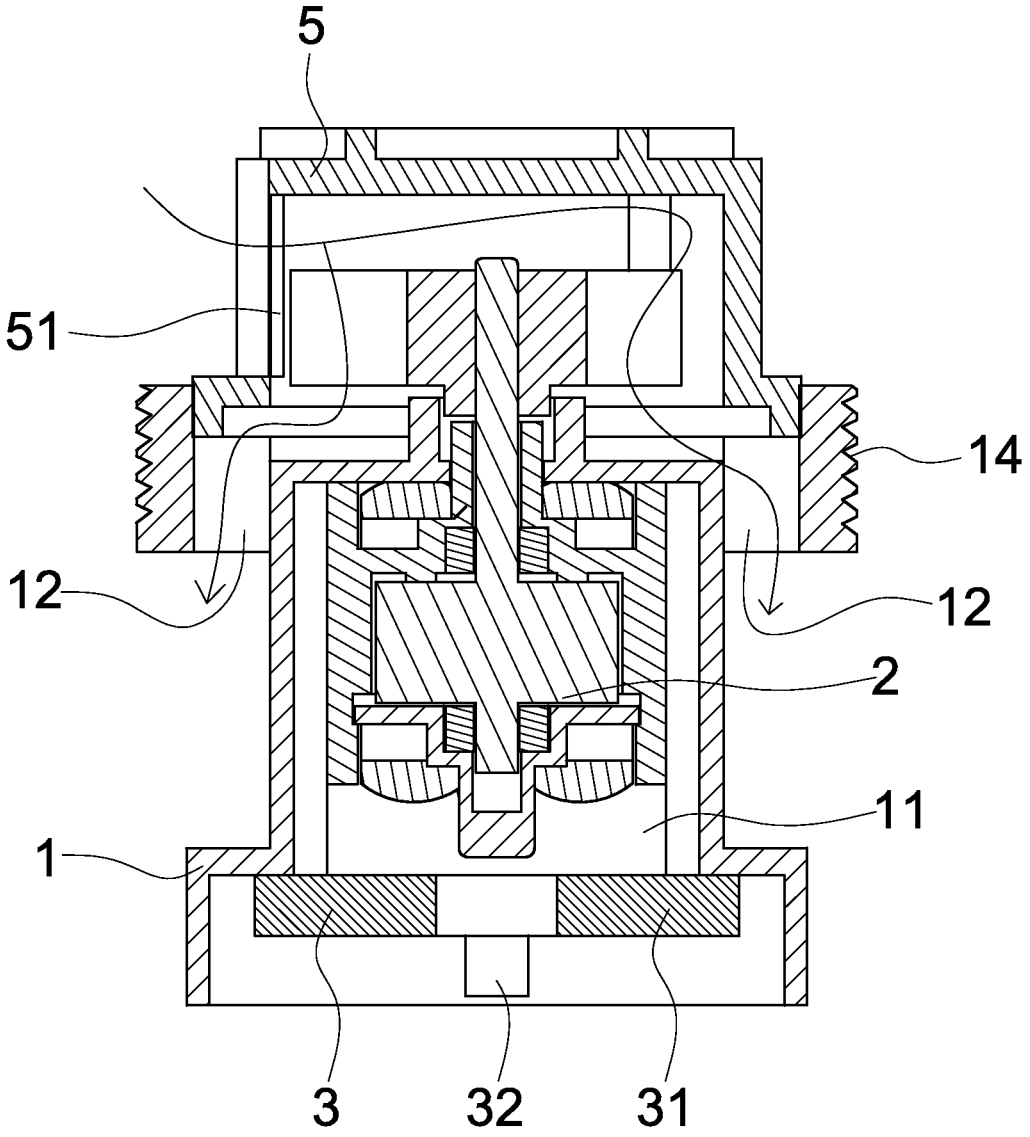
FIG. 6 shows the operation diagram of the embodiment shown in FIG. 1.
Figure 7:
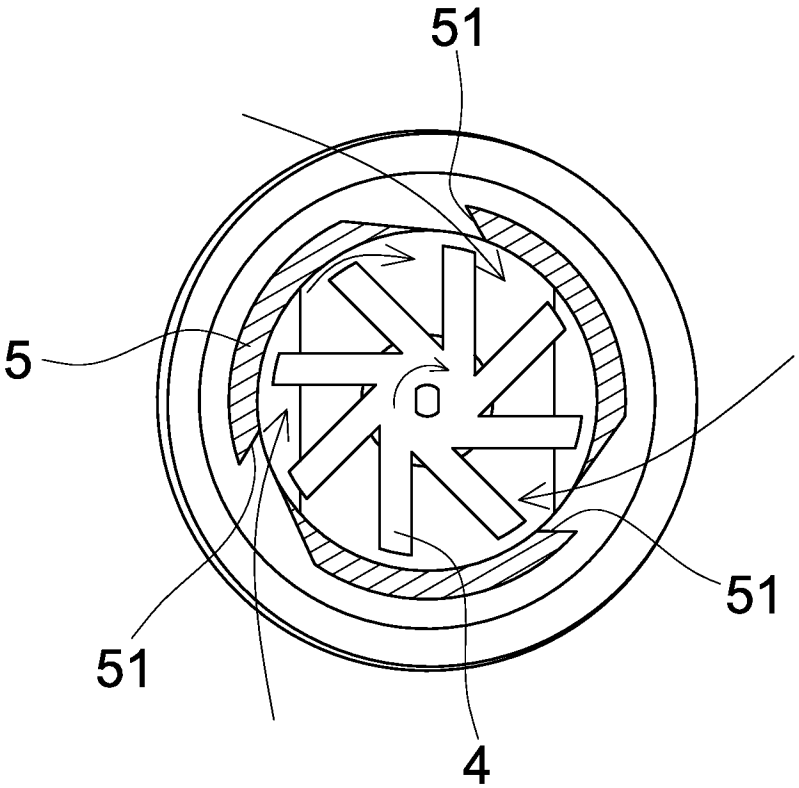
FIG. 7 shows the operation diagram of the embodiment shown in FIG. 1.

When using the lighting micro hydraulic power generator of the present invention, it is able to be screwed with the screw thread 14 of the leaving water shell 1 to a water tube 9 (such a hose of shower nozzle or flexible tube connected to a water tap 95) (as shown in FIG. 5).

When the user turns on the water flow, the water flowing through the water tube 9 will flows into the entering water holes 51 of the entering water cover 5 (shown in FIG. 6) and then goes toward the leaving water holes 12 of the leaving water shell 1 (shown in FIG. 7) and rotates the fan 4. The rotating fan 4 would drive the input axis 21 of the coil module 2 to drive the coil module 2 to generate power to the lighting module 3 when the fan 4 rotates. The lighting units 32 then emit light (shown in FIG. 5).

Thus, the lighting micro hydraulic power generator of the present invention is able to generate power for lighting when the water flows. Thus the object needed to be cleaned up by the water can be illuminated.

Referring to FIG. 1, the input axis 21 of the coil module 2 has a flexible plug 22 on it to prevent the container 11 of the leaving water shell 1 from water leakage.

Figure 9:
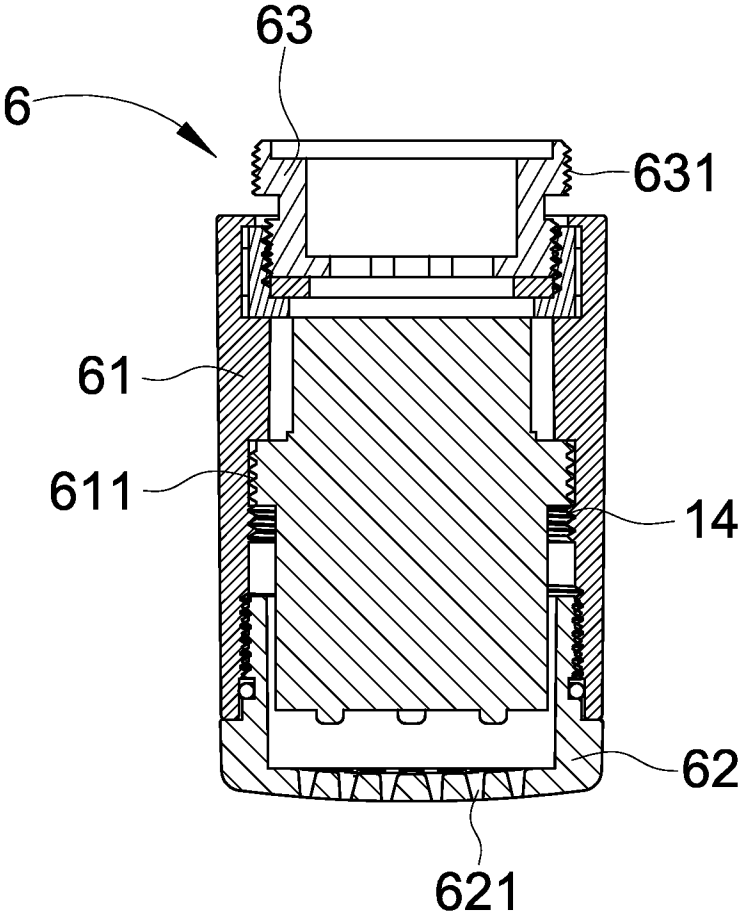
FIG. 9 shows the structure view diagram of the embodiment shown in FIG. 8.
Figure 8:
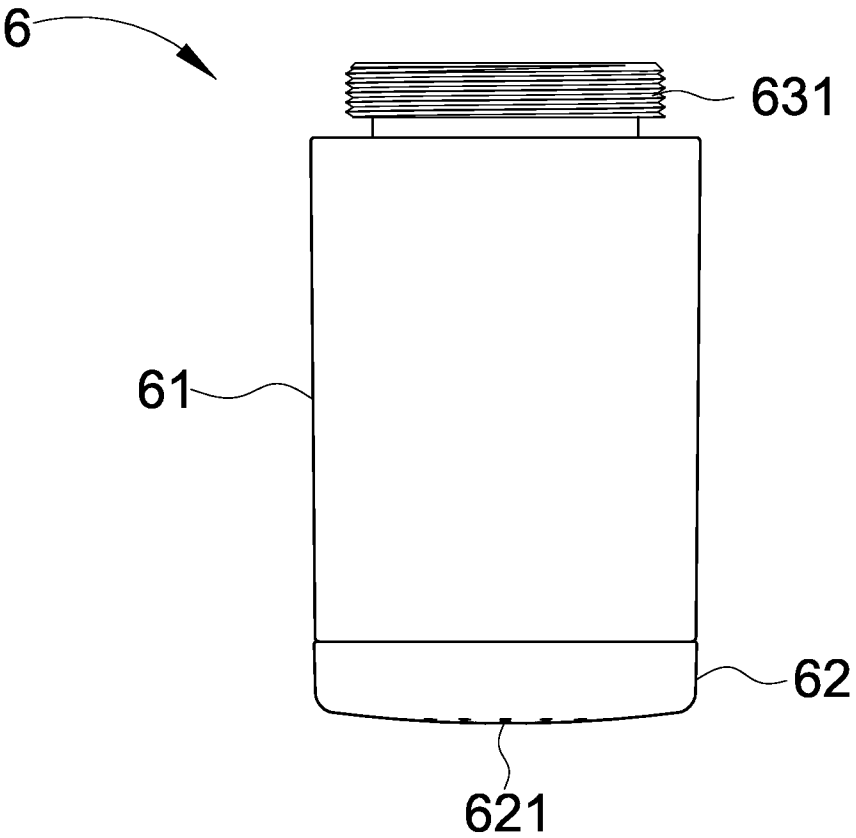
FIG. 8 shows the front view diagram of the second embodiment of the present invention.
Figure 10:
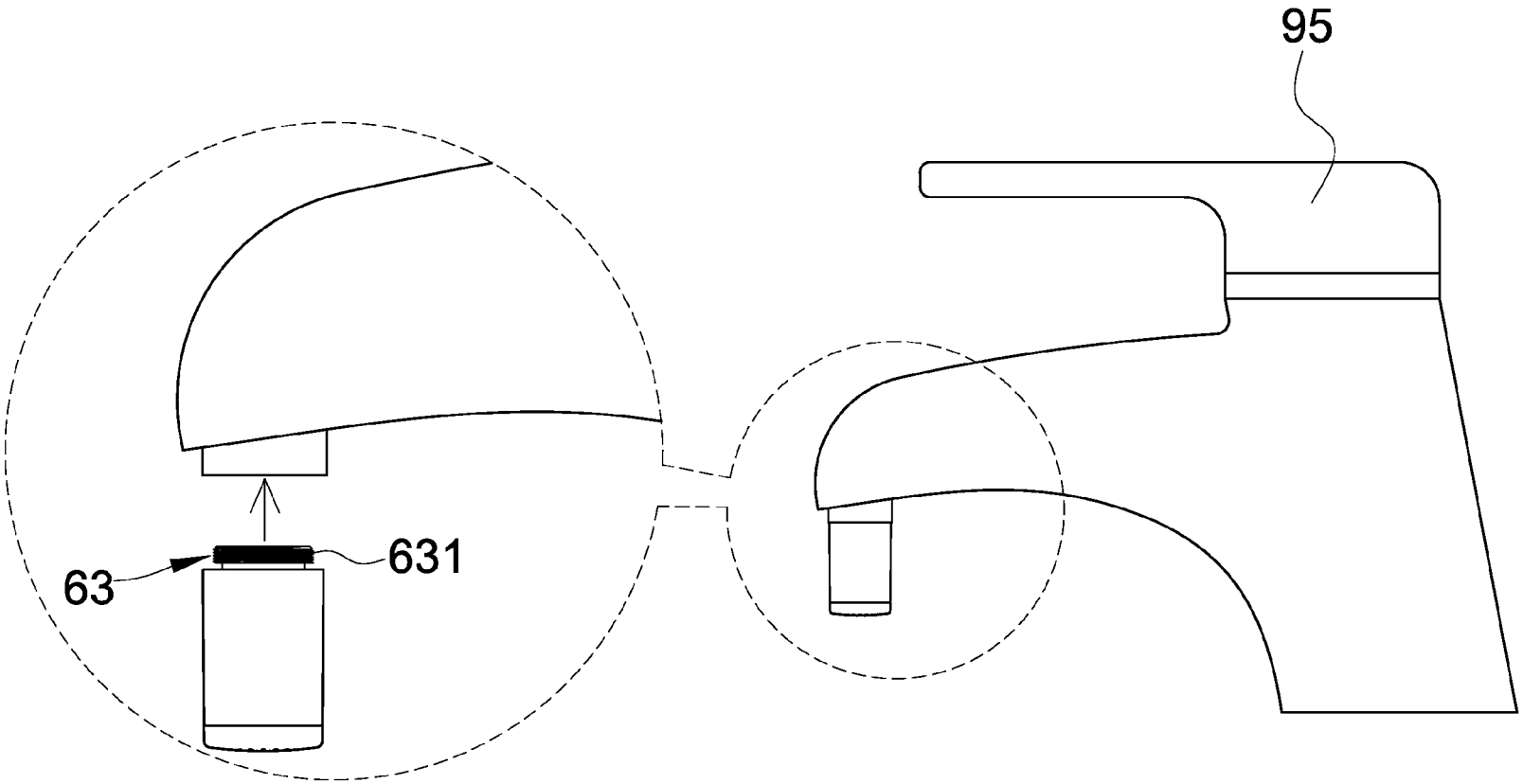
FIG. 10 shows the operation status diagram of the embodiment shown in FIG. 8.
Figure 12:
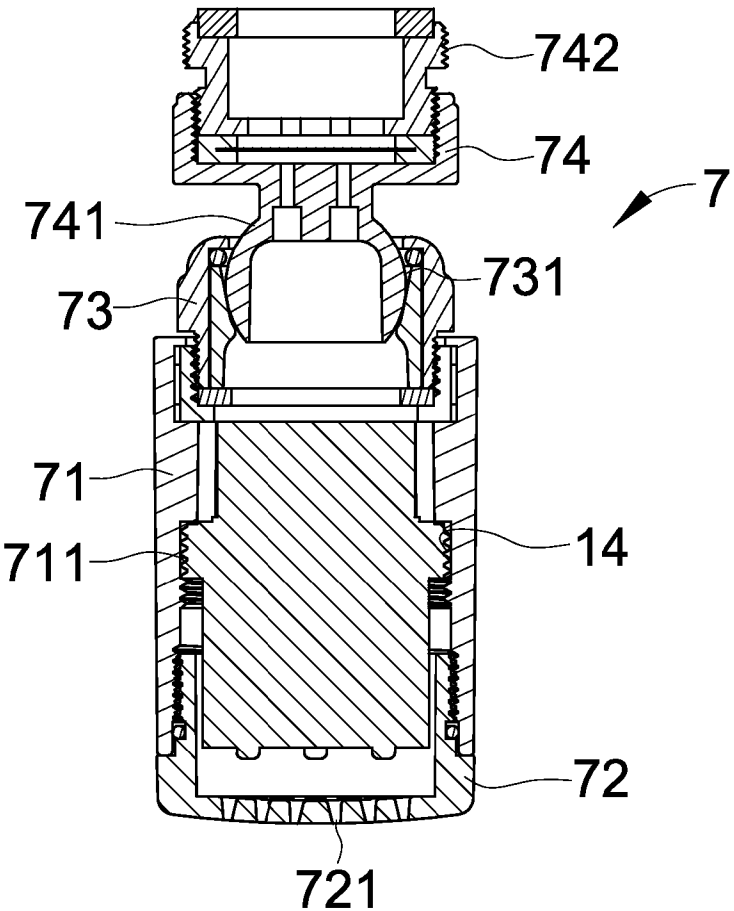
FIG. 12 shows the structure view diagram of the embodiment shown in FIG. 11.
Figure 11:
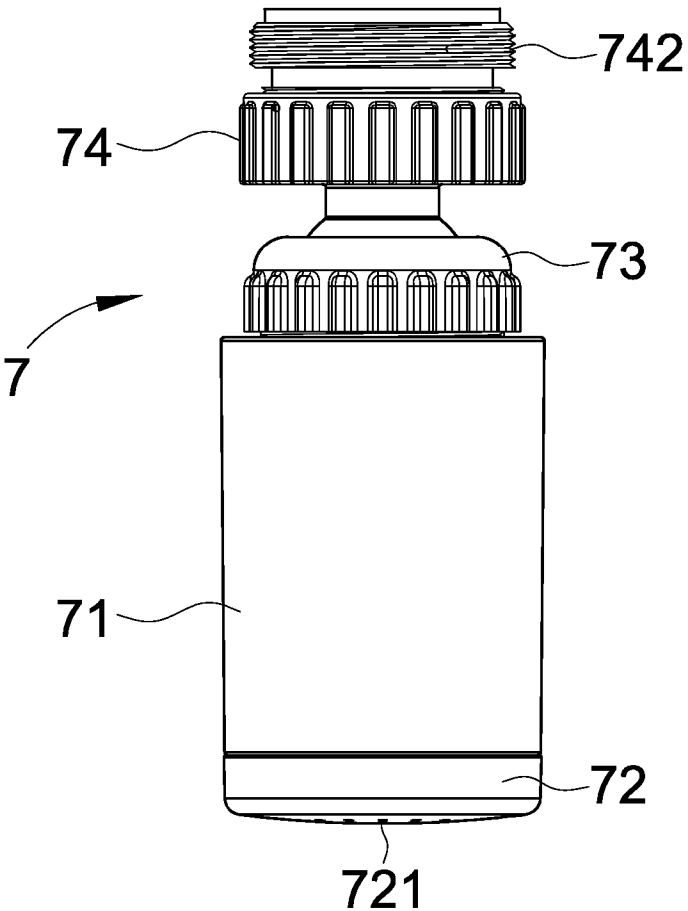
FIG. 11 shows the front view diagram of the third embodiment of the present invention.
Figure 13:
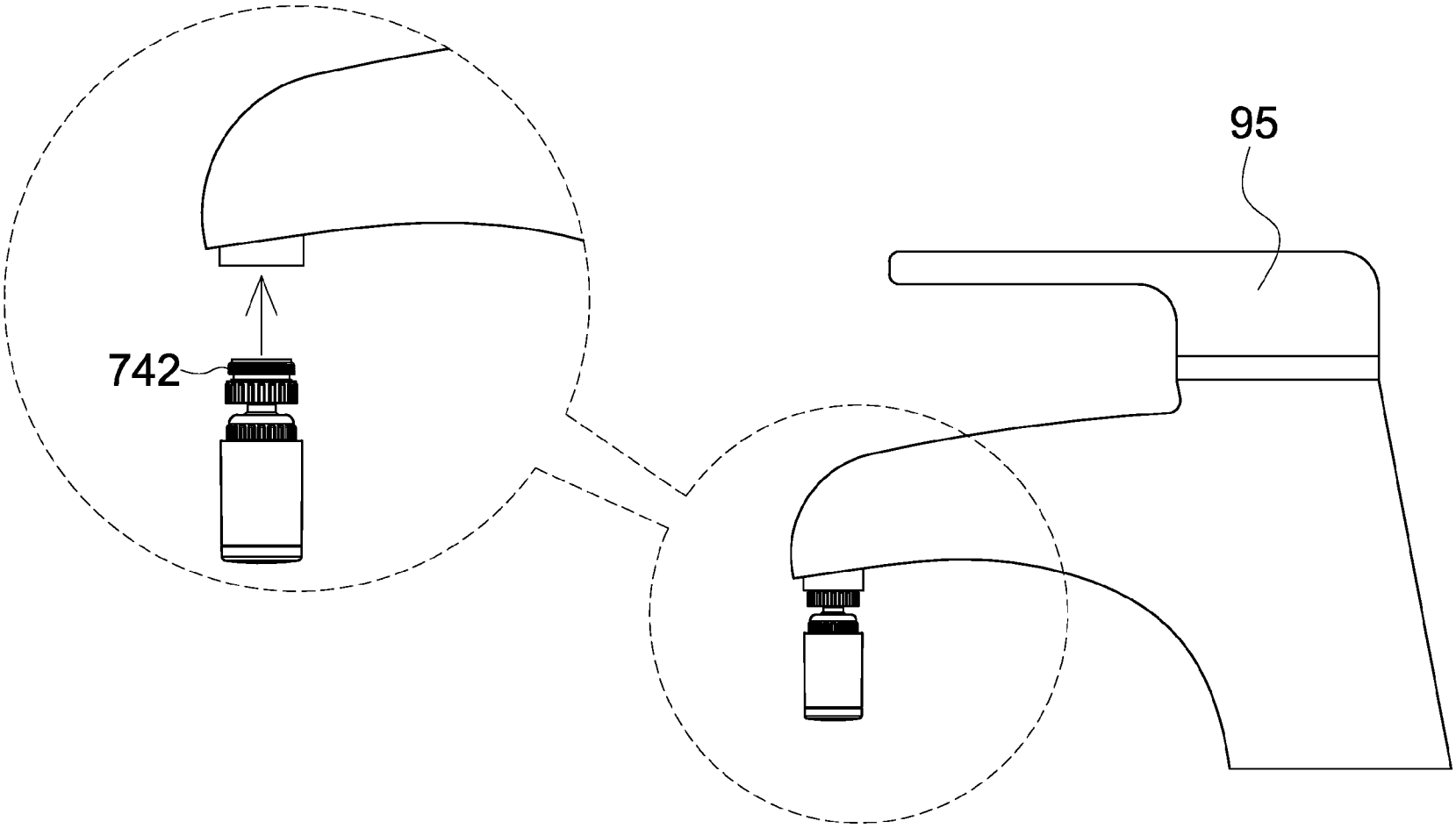
FIG. 13 shows the operation status diagram of the embodiment shown in FIG. 11.
Figure 14:
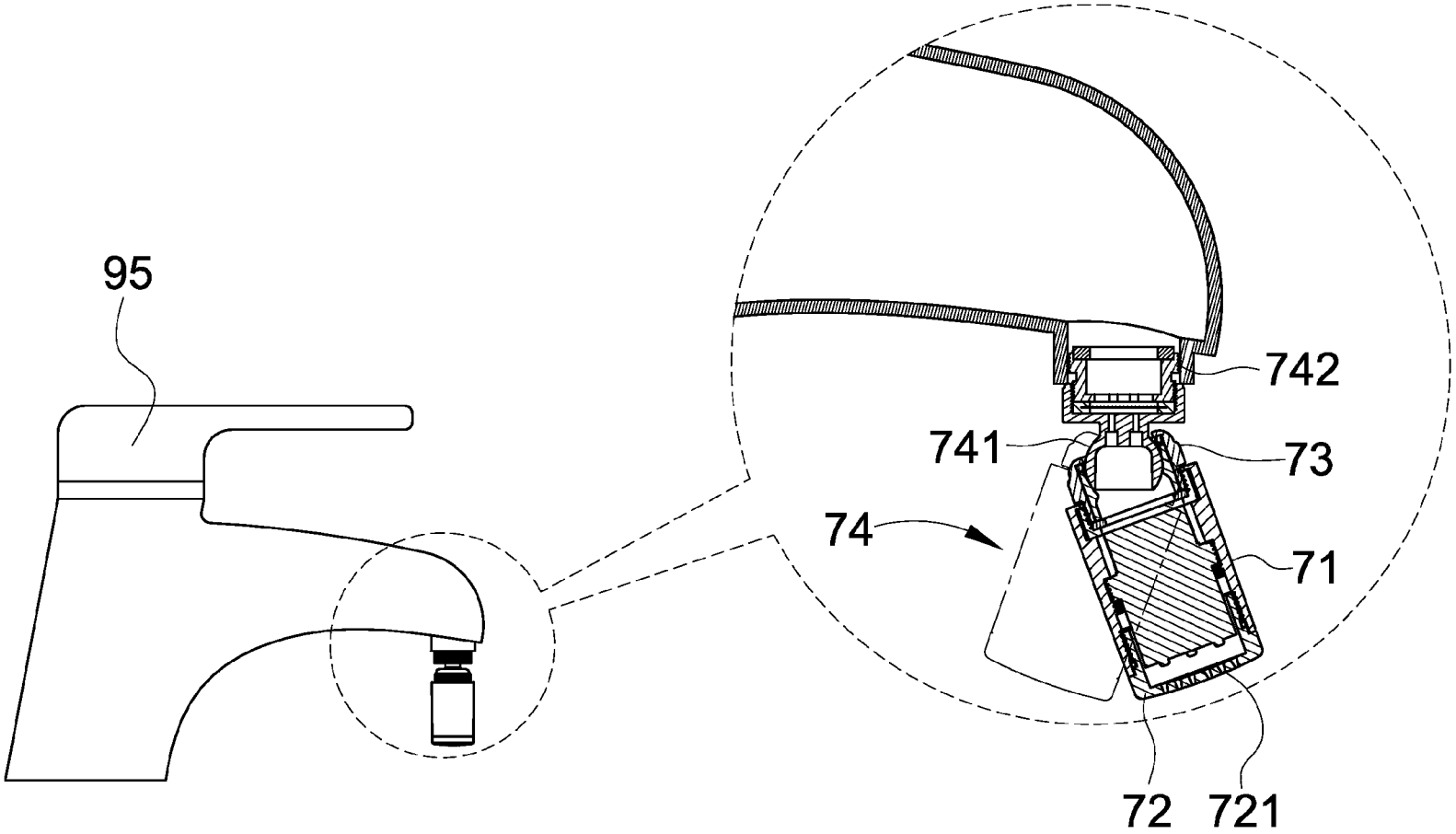
FIG. 14 shows the operation diagram of the embodiment shown in FIG. 11.

Referring to FIGS. 8-10, the second preferred embodiment of the present invention is shown. The second embodiment comprises a leaving water shell 1, a coil module 2, a lighting module 3, a fan 4, an entering water cover 5, and a converting module 6. The converting module 6 has an external shell 61, a bottom shell 62, and a converting head 63, wherein the external shell 61 has a screw thread 611 matching the screw thread 14 of the leaving water shell 1 for the external shell 61 covering the leaving water shell 1, and the bottom shell 62 is screwed with the bottom of the external shell 61. The bottom shell 62 has a plurality water flowing holes 621, thus the water flowing from the leaving water holes 12 of the leaving water shell 1 can flow out from the water flowing holes 621. The bottom of the converting head 63 is screwed with the top of the external shell 61, and the top of the converting head 63 has a converting screw thread 631 for being screwed with the external water tap 95 (shown in FIG. 10). Thus, the embodiment can achieve the objectives of the present invention and is widely applied in different applications, which makes the present invention more acceptable in the market.

Referring to FIGS. 11-14, the third preferred embodiment of the present invention is shown. The second embodiment comprises a leaving water shell 1, a coil module 2, a lighting module 3, a fan 4, an entering water cover 5, and a converting module 7. The converting module 7 has an external shell 71, a bottom shell 72, a converting base 73 and a rotation head 74, wherein the external shell 71 has a screw thread 711 matching the screw thread 14 of the leaving water shell 1 for the external shell 71 covering the leaving water shell 1, and the bottom shell 72 is screwed with the bottom of the external shell 71, the bottom shell 72 has a plurality water flowing holes 721, thus the water flowing from the leaving water holes 12 of the leaving water shell 1 can flows out from the water flowing holes 721. The bottom of the converting base 73 is screwed with the top of the external shell 71, and the top of the converting base 73 has a sphere space 731, the rotation head 74 has a sphere head 741 for being pivoted in the sphere space 731 of the converting base 73, and the top of the rotation head 74 has a converting screw thread 742 for being screwed with the external water tap 95 (shown in FIG. 13). Thus, the embodiment can achieve the objectives of the present invention and is able to change directions properly (shown in FIG. 14), which is widely applied in different applications and makes the present invention more acceptable in the market.

Figure 15:
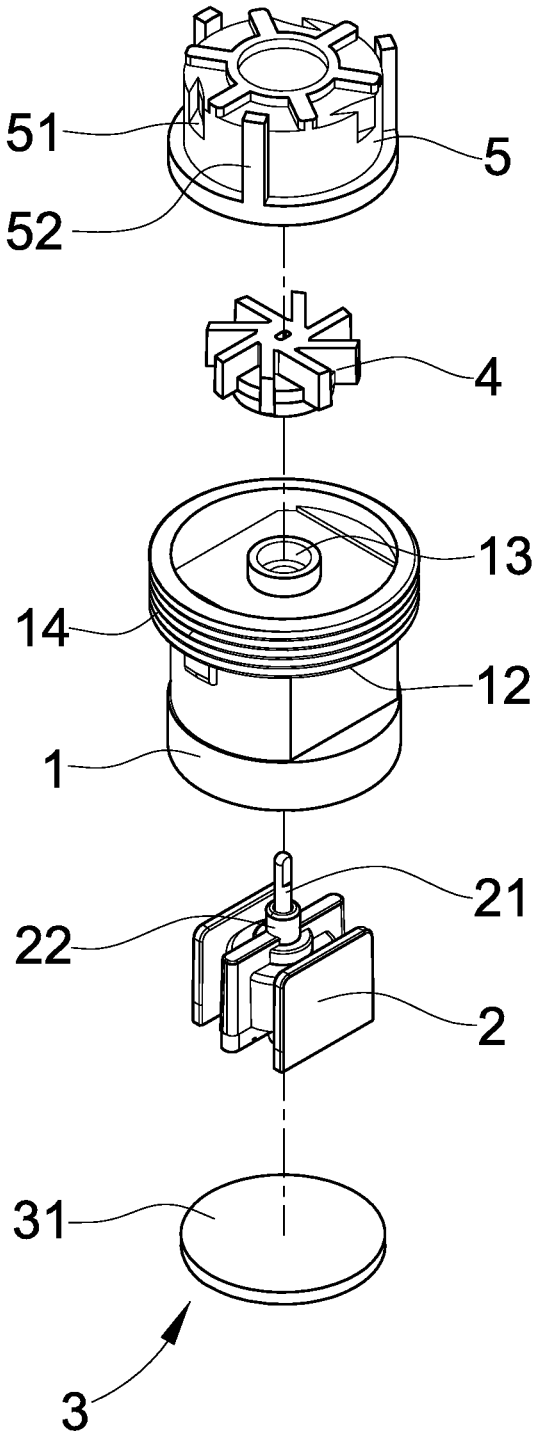
FIGS. 15 and 16 show the front view diagrams of the fourth embodiment of the present invention.
Figure 16:
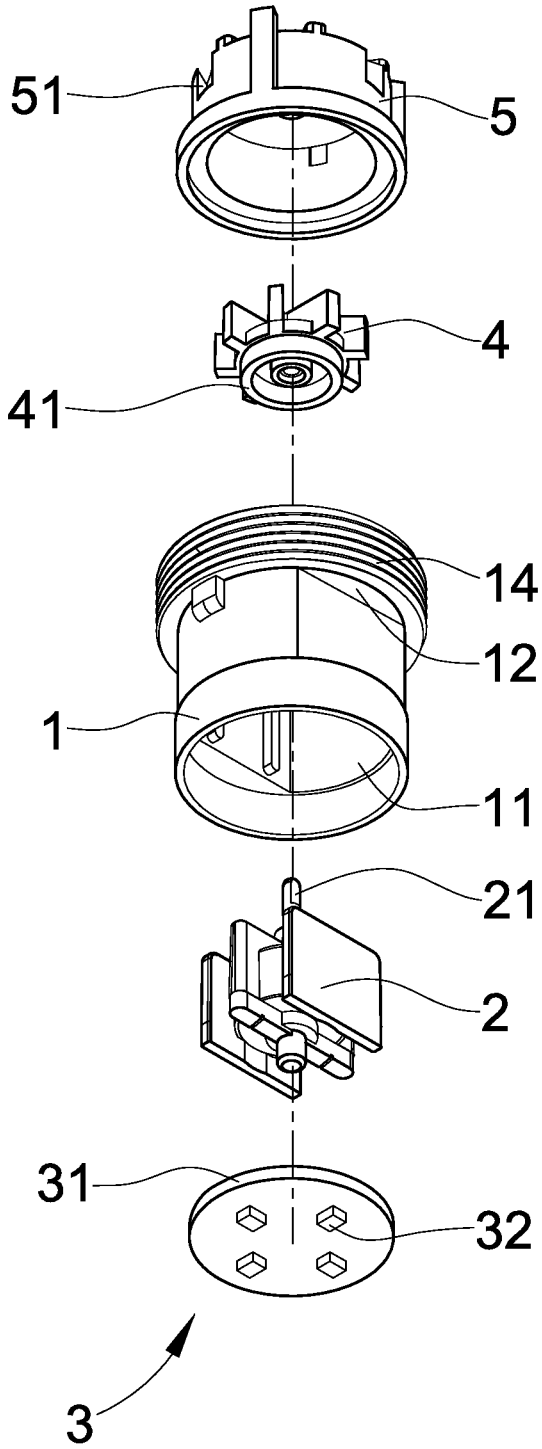

Referring to FIGS. 15-16, the fourth preferred embodiment of the present invention is shown. The entering water cover 5 is set with a plurality of pillars 52 for prevent the entering water cover from being divorced when the present invention is applied for a water tap bubble generator (not shown). The bottom of the fan 4 has a seal ring 41 to ensure the encapsulation between the fan 4 and the through hole 13, thus the water will not flow into the container 11 via the through hole 13 and interferes the lighting module 3.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lighting micro hydraulic power generator, comprising:

a leaving water shell, comprising a container, wherein the leaving water shell is set with a plurality of leaving water holes on the outside surface of the leaving water shell, and the leaving water holes are connected to the surface of the leaving water shell, and the outside surface of the leaving water shell is set with an external screw thread;

a coil module, set within the container of the leaving water shell, which is able to receiving external force for power generation and outputting power;

a lighting module, set on the bottom of the leaving water shell, wherein the lighting module is electrically connected to the coil module, and is powered by the coil module to emit light;

a fan, set on the top of the leaving water shell, wherein the fan is connected to the coil module, when the fan is driven by the external force to rotate, it is able to drive the coil module to generate and output power; and an entering water cover, set on the top of the leaving water shell, wherein the entering water cover is set with a plurality of entering water holes around the entering water cover, and the entering water holes are connected to the top of the leaving water shell, and the fan is set between the entering water holes and the leaving water holes.

2. The lighting micro hydraulic power generator as claimed in claim 1, wherein the top of the leaving water shell has a through hole to the container, and the coil module has a input axis, and the input axis protrudes outward from the through hole of the leaving water shell and is connected to the fan.

3. The lighting micro hydraulic power generator as claimed in claim 1, further comprising a converting module having an external shell, a bottom shell, and a converting head, wherein the external shell has a screw thread matching the screw thread of the leaving water shell for the external shell covering the leaving water shell, and the bottom shell is screwed with the bottom of the external shell, the bottom shell has a plurality water flowing holes, the bottom of the converting head is screwed with the top of the external shell, and the top of the converting head has a converting screw thread.

4. The lighting micro hydraulic power generator as claimed in claim 1, further comprising a converting module having an external shell, a bottom shell, a converting base and a rotation head, wherein the external shell has a screw thread matching the screw thread of the leaving water shell for the external shell covering the leaving water shell, and the bottom shell is screwed with the bottom of the external shell, the bottom shell has a plurality water flowing holes, the bottom of the converting base is screwed with the top of the external shell, and the top of the converting base has a sphere space, the rotation head has a sphere head for being pivoted in the sphere space of the converting base, and the top of the rotation head has a converting screw thread.

* * * * *